US006455113B1

(12) United States Patent
Bilodeau

(10) Patent No.: US 6,455,113 B1
(45) Date of Patent: Sep. 24, 2002

(54) ARTIFICIAL SNOW TILE SYSTEM

(76) Inventor: Paul Emile Bilodeau, 16581 Marc Allen Dr., N. Ft. Myers, FL (US) 33917

( * ) Notice: Subject to any disclaimer, the term of this patent is extended or adjusted under 35 U.S.C. 154(b) by 0 days.

(21) Appl. No.: 09/432,015

(22) Filed: Nov. 2, 1999

Related U.S. Application Data

(60) Provisional application No. 60/148,080, filed on Aug. 10, 1999.

(51) Int. Cl.[7] ..... B44F 7/00

(52) U.S. Cl. ..... 428/15; 428/7; 428/33; 428/192; 428/687; 362/806; 362/147; 362/153; 362/153.1; 52/311.2; 52/311.1; 52/557

(58) Field of Search ..... 428/15, 7, 33, 428/192, 687; 52/311.2, 557, 311.1; 362/806, 145, 147, 153, 153.1; 40/800

(56) References Cited

U.S. PATENT DOCUMENTS

| | | | | |
|---|---|---|---|---|
| 888,530 | A | * | 5/1908 | Pugh |
| 1,776,999 | A | | 9/1930 | Jensen |
| 1,890,127 | A | | 12/1932 | Oftedahl |
| 2,221,194 | A | | 11/1940 | Keller et al. |
| 3,020,811 | A | | 2/1962 | Lincoln et al. |
| 3,302,013 | A | | 1/1967 | Richardson |
| 3,350,092 | A | * | 10/1967 | Maki |
| 3,443,492 | A | | 5/1969 | Pleass |
| 3,547,749 | A | | 12/1970 | White et al. |
| 3,616,103 | A | | 10/1971 | Greiner et al. |
| 3,704,365 | A | | 11/1972 | Miller |
| 3,736,847 | A | | 6/1973 | Hickey |
| 3,959,542 | A | * | 5/1976 | Livermore |
| 4,734,302 | A | | 3/1988 | Baskin |
| 4,992,914 | A | * | 2/1991 | Heiss et al. |

* cited by examiner

*Primary Examiner*—Deborah Jones
*Assistant Examiner*—Wendy Boss
(74) *Attorney, Agent, or Firm*—Allen D. Brufsky

(57) ABSTRACT

An artificial snow tile system made up of one or more artificial snow tiles, which are optionally backlightable and wind-resistant, for affixing to a surface; an artificial snow tile having a rough surface having a dull white luster to resemble one or more layers of fallen snow, and at least two edges that are opposite each other and mirror images of each other, such that an edge may be lined up with a respective opposite edge of another tile so as to create a smooth continuous snow drift appearance without visible gaps between the edges.

10 Claims, 2 Drawing Sheets

ARTIFICIAL SNOW TILE SYSTEM

CONTINUING DATA/INCORPORATED MATTER

This application claims the benefit of provisional application Ser. No. 60/148,080 filed Aug. 10, 1999 which is hereby incorporated by reference.

BACKGROUND OF THE INVENTION

1. Field of Invention

This invention relates to artificial snow tiles. More specifically, this invention relates to artificial snow tile systems. More specifically, this invention relates to artificial snow tile systems that are optionally provided with aerodynamic features and backlightability.

2. Description of the Prior Art

Seasonal decorations are increasingly popular and snow motifs for the Christmas season are overwhelmingly the most popular themes. Snow is rare before or on Christmas in the U.S. Northeast and most of the remaining United States. As a result, many people attempt to make snow like decorations using cloth, white plastic film, or painted plywood panels. There is even use of dense powders and the like. There is however no easily portable realistic system to synthesize the appearance of snow drifts.

In addition to the need for decorative snows, there is a further need for simulated snow for winter sports. In these uses, plastic pads, coatings, and tiles have been used. The surface may be a flat poured slippery surface such as high density polyethylene, or it may be roughened to make it more snow-like. In the most effective simulated functional snows, fibrous mats of polymeric materials are used to give a surface like the working end of a scrub brush that allows ski actions. These simulated functional snow surfaces are neither snow like in appearance nor decorative.

There is a need for an easy-to-use decorative surface that looks like snow and is useful as part of a seasonal decoration scheme.

SUMMARY OF THE INVENTION

The present invention provides a simple, easy to use and easy to store, reusable, decorative interlocking or intermeshing artificial snow tile system comprising one or more artificial snow tiles. The tiles are provided with a rough surface, have a dull white luster and are optionally backlightable and wind-resistant. While a tile may be almost any dimension and thickness; preferably, the tile is at least 12 inches in one direction (width or length) and preferably made of minimal thickness, typically under 0.1 inches.

The platelets can be made of any material, or combination of materials, that are inherently, or modifiably can be, shaped and colored to appear snow-like. Such materials include, but are not limited to, plastic, foam, metal, wood, a combination of incompatible polymers, a combination of partially incompatible polymers, filled polyethylene, filled polystyrene, filled polypropylene, polyethylene with at least 4% polypropylene content and polyethylene with at least 4% polystyrene content.

An important part of the decorative aspect of the invention is a roughness of the surface which consists of either small lumps within a flattened luster material or a highly flattened material made by mixture of partially or wholly incompatible polymers or by addition of mineral fillers in addition to pigments in quantities which aid in producing a flat, luster or reflection free surface.

The platelet is tile-like in that it provides a snow-like surface and this surface is pre-formed prior to use by any of a number of methods to show humps, lumps and drifts typical of actual snow appearance.

Several additional features work together to provide backlighting ability for enhanced visual impact, to provide a smooth continuous drift look and to increase resistance to wind forces.

Generally, the edges of a platelet can be any shape: straight, curved or otherwise. In the most preferred embodiment, the edges of the platelet are irregularly shaped. Regardless of the particular shape used, the shapes of opposite edges (top-bottom, right-left) must be mirror images of each other so they may either interlock or intermesh with other tiles for creating continuous stretches of the snow-like tiles that are many tiles wide and/or long and are without gaps, which detract from the snow drift appearance.

With a preferred embodiment, the interlocking edges are set as seemingly irregular edges but the attaching edges also conform to the same seemingly irregular configuration so that the edges in fact meet along the entire irregular length of the platelet. S shapes, Z shapes, other geometrical combinations or random shapes may be used to form the edges. It is important that the platelets are arrangable in a full edge to edge configuration or a configuration such that the tiles overlap adjacent tiles to create the same continuous snow drift appearance.

The elements that must cooperate in forming a decoration that is realistic are internal lighting chambers or channels, a rough surface that varies in thickness, and edges that intermesh or interlock.

The snow platelets of snow appearing plastic are arranged with small passages in the edges which are approximately normal to the overall edge of the platelet and which allow the passage of wires from tile to tile. The use of these passages is to allow the internal lighting of the snow appearance platelets, thus providing the look of glowing mounds of snow, or in some cases using well known flashing light systems, of snow banks that momentarily light up.

A further feature of the snow appearing platelets is the ability to be affixed by affixing methods to the ground or to roof surfaces. A series of attaching means may be employed to attach the platelets to the ground or roof surfaces or to interlock the platelets with roof shingles. Attaching can be effectuated via tacks, nails, VELCRO (™), screws, glue, tape or any other well known and obvious attaching means. Interlocking with roof shingles may be effectuated with tabs or other obvious or well known shapes or configurations that are connected to the platelets and emanate from the bottom or sides of the platelets, where the tabs or other configurations engage roof shingles to hold the platelets securely to a roof surface. For example, engagement may be effectuated by having a tab underlie a roof shingle.

Additionally, flap and ledge pairs may be molded into the opposite platelet edges (top-bottom, right-left), with or without pre-formed holes, so that a nail, tack, stake or other similar attaching means may pass through the edge and engage the surface to which the platelet is to be attached. The flap and ledge pairs are distinct from the means for attaching tiles to a surface, as discussed above. The flaps and ledges should be carefully positioned along the edges so that they may cooperatively overlap, or be overlapped by, the flap or ledge of an adjacent platelet. In the preferred embodiment, the flaps have preformed holes and are located towards the middle of the edges to best secure the platelets to a surface and to help minimize Bernoulli vacuum points at the edges of the platelets. While flaps and ledges are not required, they are preferred. For example, rather than having to pass a nail through a decorative part of a tile, it may be passed through a flap-ledge pair so as not to detract from the decorative aspects of the tile.

In addition to the affixing means, an aerodynamic shape may be formed on the platelet surface so that air flowing over the top of the platelet exerts a downward holding force upon the platelet. A domed shape, bump or similar shape located at the edges further enhances the design which helps prevent Bernoulli vacuum points at the edges of the platelets and thus aids in the hold down of the tiles in storm or windy conditions. The wind forces are minimized by the provision of the domed shape, bump or similar shape which cause a downward force at the front edges of the shapes much like the shape of an airplane wing. It has been found that it is not necessary to have the wing shape lumps continuous but if they are at or near the corners of each shape, the wind forces direct downward and help hold the shape to a roof or to the ground.

DETAILED DESCRIPTION OF THE INVENTION

Figure 1:
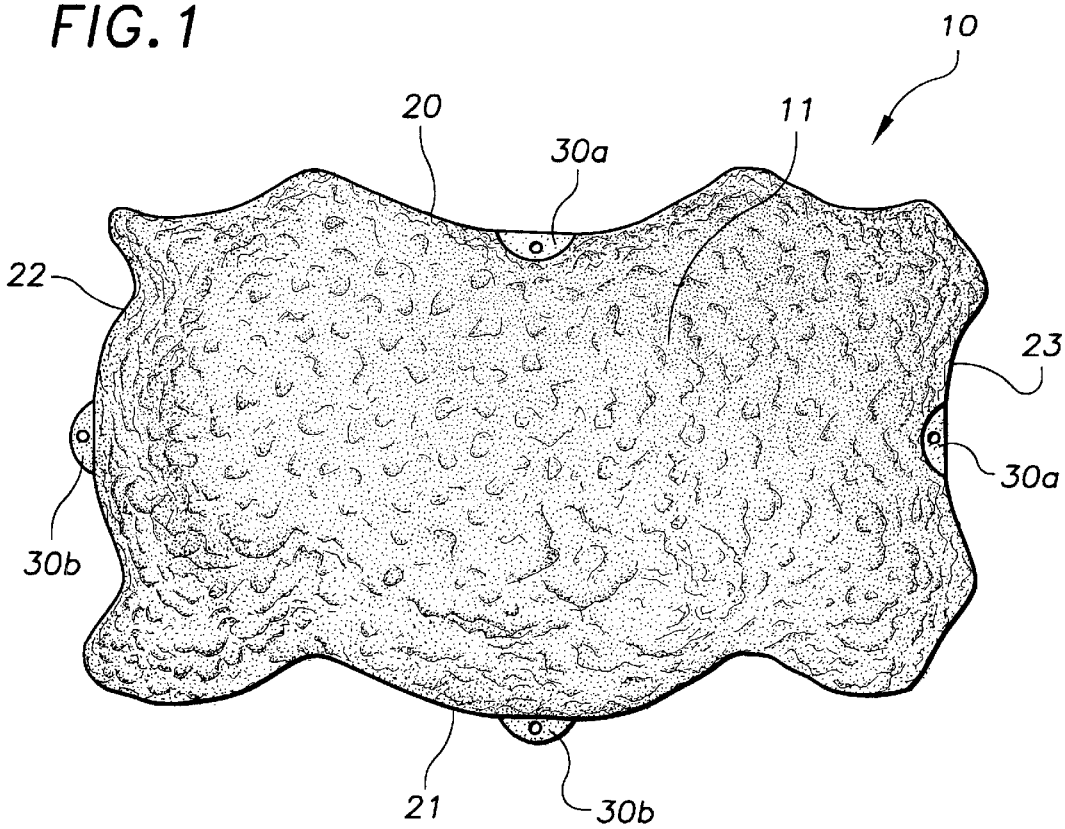
FIG. 1 shows a top view of a tile according to the invention.

As shown in FIG. 1, an artificial snow tile 10 is provided with a rough surface 11, which consists of humps, lumps and drifts typical of an actual snow appearance. This surface 11 gives the appearance of an actual snow drift.

Tile 10 is provided with a first edge 20 and a second edge 21 that are opposite each other. Tile 10 is also provided with a third edge 22 and a fourth edge 23 that are also opposite each other.

Tile 10 is preferably provided with a ledge 30*a* and flap 30*b* located at opposite edges, respectively; which cooperatively assist in attaching tile 10 to a surface, such as the ground or a roof, and to assist in holding interlocked or intermeshed tiles together.

Figure 2:
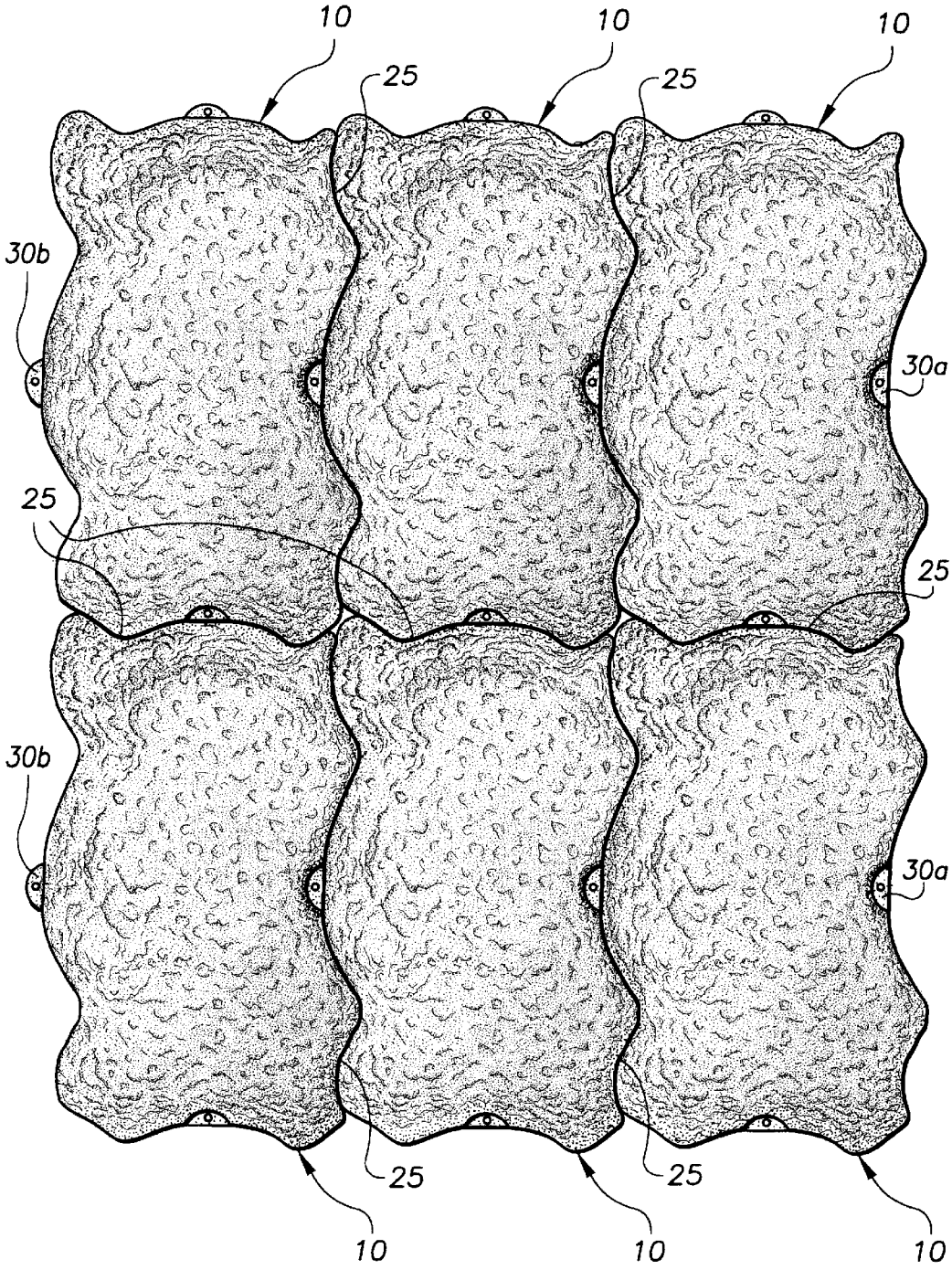
FIG. 2 shows a top view of 6 tiles in a 2×3 arrangement with corresponding edges aligned according to the invention.

As shown in FIG. 2, tiles 10 may be arranged in an edge-to-edge arrangement; and for illustrative purposes, are set out in a 2×3 arrangement. As can be seen, when the tiles 10 are set edge-to-edge, whether in a side-by-side and/or top-to-bottom arrangement, a continuous snow drift appearance along the area covered by the interlocked (or intermeshed) tiles 10 is provided. As shown by the meeting point 25, the edges are interlocked (or intermeshed) such that generally no visible gaps appear that would detract from the continuous snow drift appearance.

As also shown in FIG. 2, tiles 10 are preferably provided with two ledges 30*a* and two flaps 30*b* located at respective opposite edges.

Figure 3:
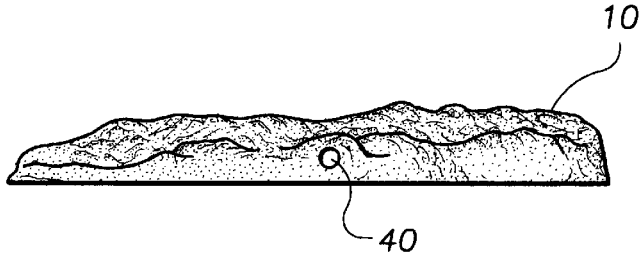
FIG. 3 shows a side view of a tile having with an exposed passage for wires.

Referring to FIG. 3, a tile 10 is optionally provided with a small passage 40 in at least two edges of a tile. Preferably, the passage is approximately normal to the overall edge of the platelet. The passage(s) allow the passage of electrical wires from tile to tile when the optional backlighting feature is employed.

In a preferred method of use, more than one tile 10 is used to provide the appearance of a long, interrupted snow drift appearance. Reference to FIG. 2 is helpful. A user places on a surface (i.e., ground) two tiles 10 along two corresponding edges with the flap of one edge overlying the ledge of the other edge aligning the holes provided with the ledge and flap. Next, a nail, tack, stake or similar attachment item is passed through the aligned holes to engage the surface underlying the tiles so as to attach the tiles to the surface along the corresponding edges. The result is two tiles attached to the surface at one edge. Each tile 10 is left with three vacant edges with respective ledges 30*a* and flaps 30*b*.

For each additional tile added to the arrangement above, the following general procedure above is repeated. For example, a third tile 10 is added by placing it on the surface and aligning its respective edge with a vacant edge such that the holes of the respective ledge 30*a* and flap 30*b* are aligned. Then a nail, tack, etc . . . , is passed through the aligned holes to engage the surface underlying the tiles.

When a user is finished adding tiles to the arrangement, he or she then secures all vacant edges by passing a nail, tack, etc . . . , through the hole of the respective ledge 30*a* or flap 30*b* such the edges are secured to the surface underlying the tile or tiles.

As can be seen, the arrangement is simple, convenient and effective in providing the appearance of a snow drift.

There are a number of methods for manufacturing the tiles, which are described below. This list is merely indicative and not comprehensive.

The material for this product in the most preferred version is a combination of incompatible polymers or of partially incompatible polymers which, because the polymers do not mix or dissolve in each other, creates a marked milky surface dulled by the intermixing of the non-compatible materials. An alternate material is a filled polyethylene, polystyrene or polypropylene. It is noted that pigmented polymers would also work but are less preferred.

Manufacture of the preferred version of this invention is by thermoforming. The thermoforming process provides a surface that is easily conformed to a mold shape by heating a plastic sheet and pulling this heated and thermally softened sheet over the mold where it is vacuum pulled onto the cooled mold surface where the softened plastic again hardens, or by pressing the softened sheet onto the mold by air or membrane pressure on the side of the softened sheet away from the mold to press the sheet into the mold where it hardens. A combination of vacuum pull and air or membrane pushing forces is also often used to provide even faster action in forming and to allow more control over deep or complex shapes.

An alternate manufacture is by injection molding where polymers are melted in a screw or in a hot cylinder and then pressed into the space between two blocks of steel which make a mold. The blocks of steel are cooled and thus the molten polymer hardens or solidifies within the mold producing a part with a shape corresponding to the cavity or space between the steel blocks.

Yet a third method of manufacture is by injection blow molding where a double layer platelet is formed by taking a tubular pre-form of polymer and heating it to near molten then injecting air into the middle of the tube to force the tube onto the walls of a mold. This method allows strong thin walls as in soda bottles but it is not optimal for thin platelets. There are many other possible methods of manufacture but the above are the most logical methods.

Therefore, I claim:

1. An artificial snow tile system comprising a multiple array of snow tiles, wherein each artificial snow tile comprises a rough surface having a dull white luster to resemble one or more layers of fallen snow, means for affixing a tile to a surface first and second edges, opposite each other and mirror images of each other, wherein an edge is abutted with a respective opposite edge of another tile to create a smooth continuous snow drift appearance without visible gaps between edges and said tiles being backlightable, wherein said opposed first and second edges of a tile are provided with at least one passage, and at least one electrical wire threaded through a pair said passages in said first and second edges enabling the array of abutted tiles to be backlightable without exposure of a wire.

2. The artificial snow tile system of claim 1, wherein a tile further comprises third and fourth edges, opposite each other and mirror images of each other.

3. The artificial snow tile system of claim 1, wherein a tile is at least about 12 inches in one direction.

4. The artificial snow tile system of claim 1, wherein a tile is under about 0.1 inches thick.

5. The artificial snow tile system of claim 1, wherein the tile edges are adapted to interlock.

6. The artificial snow tile system of claim 1, wherein the tile edges are adapted to intermesh.

7. The artificial snow tile system of claim 1, wherein a tile is made of a material selected from the group consisting of plastic, foam, metal, wood, a combination of incompatible polymers, a combination of partially incompatible polymers, filled polyethylene, filled polystyrene, filled polypropylene, polyethylene with at least 4% polypropylene content and polyethylene with at least 4% polystyrene content.

8. The artificial snow tile system of claim 1, wherein the shape of an edge is selected from the group consisting of an S-shape, a Z-shape, a flat shape and an irregular shape.

9. The artificial snow tile system of claim 1, wherein one or both pairs of opposite edges of a tile are each provided with a respective flap and ledge.

10. The artificial snow tile system of claim 1, wherein a tile is provided with a wind-resistant shape.

* * * * *